US012441526B2

(12) United States Patent
Dong et al.

(10) Patent No.: US 12,441,526 B2
(45) Date of Patent: Oct. 14, 2025

(54) CUP LID AND CUP

(71) Applicant: Shenzhen Mould-Tip Injection Technology Company Limited, Guangdong (CN)

(72) Inventors: Zhongming Dong, Guangdong (CN); Hekun Xiao, Guangdong (CN)

(73) Assignee: Shenzhen Mould-Tip Injection Technology Company Limited, Shenzhen (CN)

( * ) Notice: Subject to any disclaimer, the term of this patent is extended or adjusted under 35 U.S.C. 154(b) by 55 days.

(21) Appl. No.: 18/539,448

(22) Filed: Dec. 14, 2023

(65) Prior Publication Data

US 2024/0383653 A1 Nov. 21, 2024

(30) Foreign Application Priority Data

May 19, 2023 (CN) ..... 202321235715.6

(51) Int. Cl.
*A47G 19/22* (2006.01)
*B65D 43/02* (2006.01)
*B65D 51/16* (2006.01)

(52) U.S. Cl.
CPC ..... *B65D 51/1611* (2013.01); *A47G 19/2272* (2013.01); *B65D 43/0204* (2013.01); (Continued)

(58) Field of Classification Search
CPC ..... B65D 2543/00046; B65D 2543/00092; B65D 2543/00296; B65D 51/1611; (Continued)

(56) References Cited

U.S. PATENT DOCUMENTS 8,631,957 B2 * 1/2014 Dart ..... B65D 47/089 220/254.3
10,016,079 B2 * 7/2018 Chiang ..... B65D 43/02
(Continued)

FOREIGN PATENT DOCUMENTS

CN 108408235 A 8/2018
CN 207972992 U 10/2018
(Continued)

OTHER PUBLICATIONS

ISA/CN, International Search Report and Written Opinion for International Patent Application No. PCT/CN2023/128427, mailed Feb. 1, 2024, 14 pages.

*Primary Examiner* — King M Chu
(74) *Attorney, Agent, or Firm* — NK Patent Law

(57) ABSTRACT

A cup lid and a cup are disclosed. The cup lid includes a lid body and a first cover, the lid body is provided with a water storage tank and a vent hole, and the vent hole extends through the lid body and is located in the water storage tank. The first cover is connected to the lid body, and the first cover is capable of moving to a first position relative to the lid body. When the first cover is located at the first position, the first cover covers at least a part of the water storage tank. By connecting the first cover movably to the lid body, when the water storage tank needs to be covered to reduce liquid flowing out to the outside, the first cover is driven to the first position to cover the water storage tank, so that functions can be realized conveniently and quickly, and the probability of losing the first cover is reduced.

8 Claims, 7 Drawing Sheets

(52) U.S. Cl.
CPC ..... *B65D 2543/00046* (2013.01); *B65D 2543/00092* (2013.01)

(58) Field of Classification Search
CPC ..... B65D 43/0204; B65D 43/0212; B65D 2205/00; A47G 19/2272; A47G 19/22
USPC ..... 220/713, 254.3, 715, 254.1, 367.1
See application file for complete search history.

(56) References Cited

U.S. PATENT DOCUMENTS

| | | | | |
|---|---|---|---|---|
| 10,759,574 | B1 * | 9/2020 | Li | B65D 43/0218 |
| 2015/0096151 | A1 | 4/2015 | Corio | |

FOREIGN PATENT DOCUMENTS

| | | | |
|---|---|---|---|
| CN | 209769935 | U | 12/2019 |
| CN | 210556615 | U | 5/2020 |
| CN | 213385597 | U | 6/2021 |
| CN | 113212967 | A | 8/2021 |
| CN | 216660969 | U | 6/2022 |
| CN | 219845988 | U | 10/2023 |

* cited by examiner

CUP LID AND CUP

CROSS-REFERENCE TO RELATED APPLICATION

This application is based on and claims the benefit of priority from Chinese Patent Application No. 2023212357156, filed on 19 May 2023, the entirety of which is incorporated by reference herein.

TECHNICAL FIELD

The present disclosure relates to the technical field of liquid containers, and more particularly, to a cup lid and a cup.

BACKGROUND

In order to balance an air pressure in a cup filled with hot drinks, a cup lid in the related art is provided with an exhaust hole, wherein the cup lid is further provided with a water storage tank, the exhaust hole is located in the water storage tank, and the cup further comprises a water storage tank cover, which covers the water storage tank to cooperate with the water storage tank to reduce the possibility of liquid flowing out of the exhaust hole. The water storage tank cover is produced separately and, in practical use, needs to be taken out and then placed on the cup lid, making the assembly steps cumbersome.

SUMMARY

The present disclosure aims to solve at least one of the technical problems in the related art. Therefore, the present disclosure provides a cup lid which can facilitate the use of the cup lid.

The present disclosure further provides a cup having the above-mentioned cup lid.

The cup lid according to an embodiment of the present disclosure comprises a lid body and a first cover, the lid body is provided with a water storage tank and a vent hole, the vent hole extends through the lid body and the vent hole is located in the water storage tank. The first cover is connected to the lid body, and the first cover is capable of moving to a first position relative to the lid body; and when the first cover is located at the first position, the first cover covers at least a part of the water storage tank.

The cup lid according to the embodiment of the present disclosure at least has the following beneficial effects. By connecting the first cover movable to the lid body, when the water storage tank needs to be covered to reduce liquid flowing out to the outside, the first cover is driven to the first position to cover the water storage tank, so that functions can be realized conveniently and quickly, and the probability of losing the first cover is reduced.

According to some embodiments of the present disclosure, the lid body is further provided with an exhaust groove, and when the first cover is located at the first position, the first cover covers the water storage tank, and the exhaust groove is communicated with the water storage tank.

According to some embodiments of the present disclosure, the exhaust groove and the vent hole are respectively located at two opposite sides of the water storage tank.

According to some embodiments of the present disclosure, one of the lid body and the first cover is provided with a clamping boss and the other of the lid body and the first cover is provided with a clamping groove, and when the first cover is located at the first position, the clamping boss is clamped in the clamping groove.

According to some embodiments of the present disclosure, the lid body is further provided with a covering groove, the water storage tank is located in the covering groove, and when the first cover is located at the first position, at least a part of the first cover is located in the covering groove.

According to some embodiments of the present disclosure, the lid body is further provided with an exhaust groove, the covering groove is provided with a groove bottom and a groove wall, the covering groove is provided with a first side and a second side, the exhaust groove is communicated with the groove wall at the first side of the covering groove, and the water storage tank is arranged at the groove bottom; the first cover comprises a first connecting part and a first covering part which are connected with each other, the first connecting part is connected to the lid body, and the first connecting part is located at the second side of the covering groove; and when the first cover is located at the first position, the first cover covers the water storage tank, and the exhaust groove is communicated with the water storage tank.

According to some embodiments of the present disclosure, the lid body is provided with a clamping boss, the first cover is provided with a clamping groove, and the clamping boss is arranged on the groove wall at the first side of the covering groove; and when the first cover is located at the first position, the clamping boss is clamped in the clamping groove; or, the lid body is provided with a clamping groove, the first cover is provided with a clamping boss, and the clamping groove is arranged on the groove wall at the first side of the covering groove; and when the first cover is located at the first position, the clamping boss is clamped in the clamping groove.

According to some embodiments of the present disclosure, the first cover and the lid body are integrally formed.

According to some embodiments of the present disclosure, the lid body is provided with a liquid outlet hole, and the liquid outlet hole extends through the lid body; the cup lid further comprises a second cover, the second cover is provided with a second connecting part, a second covering part and a clamping part, the second connecting part is connected with the second covering part, the clamping part is connected with the second covering part, the second connecting part is connected to the lid body, and the second cover is capable of moving to a second position relative to the lid body; and when the second cover is located at the second position, the second covering part covers the liquid outlet hole, at least a part of the clamping part is located in the liquid outlet hole, and the clamping part is clamped in the liquid outlet hole.

A cup according to the embodiments of the present disclosure comprises a cup body and the cup lid in the above-mentioned embodiments, wherein the cup lid covers the cup body.

The cup according to the embodiments of the present disclosure at least has the following beneficial effects. By applying the cup lid according to the embodiments of the present disclosure, the water storage tank can be conveniently and quickly covered on the basis of realizing the air pressure balance inside and outside the cup, so as to reduce the probability of the liquid flowing out to the outside.

The additional aspects and advantages of the present disclosure will be given in part in the following description, and will become apparent in part from the following description, or will be learned through the practice of the present disclosure.

BRIEF DESCRIPTION OF THE DRAWINGS

The present disclosure will be further explained with reference to the accompanying drawings and embodiments hereinafter, wherein.

Figure 1:
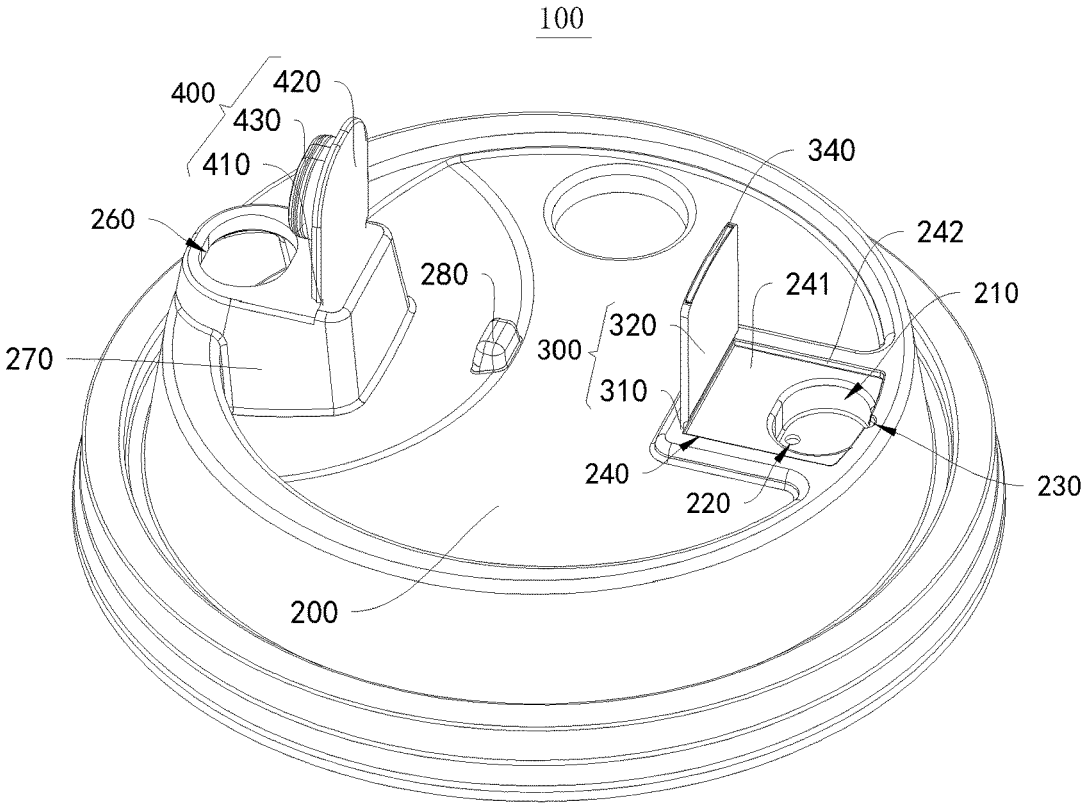
FIG. 1 is a schematic structural diagram of a cup lid in a first state according to an embodiment of the present disclosure.

Reference Numerals:

10-cup;

100-cup lid;

200-lid body, 210-water storage tank, 220-vent hole, 230-exhaust groove, 240-covering groove, 241-groove bottom, 242-groove wall, 250-clamping boss, 260-liquid outlet hole, 270-projecting part, and 280-limiting part;

300-first cover, 310-first connecting part, 320-first covering part, 330-exhaust hole, and 340-clamping groove;

400-second cover, 410-second connecting part, 420-second covering part, 430-clamping part, and 431-clamping boss; and

500-cup body.

DETAILED DESCRIPTION

Embodiments of the present disclosure will be described in detail below. Examples of the embodiments are illustrated in the accompanying drawings, where the same or like reference numerals throughout the figures indicate the same or like elements having the same or like functions. The embodiments described below with reference to the accompanying drawings are exemplary and are intended only to explain the present disclosure instead of being construed as limiting the present disclosure.

In the description of the present disclosure, it should be understood that, descriptions relating to orientation, for example, orientation or positional relationships indicated by "up", "down", "front", "back", "left", "right", etc. are based on the orientation or positional relationships shown in the accompanying drawings, and are to facilitate the description of the present disclosure and simplify the description only, rather than indicating or implying that the device or element referred to must have a specific orientation or be constructed and operated in a specific orientation, and therefore cannot be construed as limiting the present disclosure.

In the description of the present disclosure, the meaning of "several" is one or more, the meaning of "a plurality of" is two or more, "greater than", "less than", "more than", etc. are to be understood to exclude the given figure, and "above", "below", "within", etc. are understood to include the given figure. If "first" and "second", etc. are referred to, it is only for the purpose of distinguishing technical features, and shall not be understood as indicating or implying relative importance or implying the number of the indicated technical features or implying the sequence of the indicated technical features.

In the description of the present disclosure, unless otherwise explicitly defined, the words such as "set", "install", and "connect" should be understood in a broad sense, and those skilled in the art can determine the specific meanings of the above words in the present disclosure in a rational way in combination with the specific contents of the technical solutions.

In the description of the disclosure, reference to the terms such as "an embodiment", "some embodiments", "exemplary embodiment", "example", "specific example" and "some examples" means that a particular feature, structure, material, or characteristic described in connection with the embodiment or example is included in at least one embodiment or example of the present invention. In this specification, the schematic representations of the terms above do not necessarily refer to the same embodiment or example. Furthermore, the particular feature, structure, material, or characteristic described may be combined in any suitable manner in any one or more embodiments or examples.

Hereinafter, the cup lid and the cup according to the embodiments of the present disclosure will be described with reference to the accompanying drawings. It should be noted that in FIG. 2 to FIG. 4, FIG. 8 and FIG. 9, a first cover 300 is located at a first position. In FIG. 2, FIG. 3, FIG. 5, FIG. 8 and FIG. 9, a second cover 400 is located at a second position. Referring to FIG. 1 to FIG. 5 and FIG. 9, a cup lid 100 according to an embodiment of the present disclosure comprises a lid body 200 and a first cover 300. The lid body 200 is provided with a water storage tank 210 and a vent hole 220, the vent hole 220 extends through the lid body 200 and the vent hole 220 is located in the water storage tank 210. The first cover 300 is connected to the lid body 200, and the first cover 300 is capable of moving to a first position relative to the lid body 200. When the first cover 300 is located at the first position, the first cover 300 covers at least a part of the water storage tank 210. By connecting the first cover 300 movably to the lid body 200, when the water storage tank 210 needs to be covered to reduce liquid flowing out to the outside, the first cover 300 can be driven to the first position to cover the water storage tank 210, so that functions can be realized conveniently and quickly. Moreover, compared with a separate water storage tank cover in the related art, because the first cover 300 is connected to the lid body 200, the probability of losing the first cover 300 can be effectively reduced.

In some embodiments, when the first cover 300 is located at the first position, the first cover 300 only covers a part of the water storage tank 210, so as to ensure a communication channel between the water storage tank 210 and an external space and ensure that an air pressure inside and outside the cup 10 can be balanced.

Specifically, relative movement between the first cover 300 and the lid body 200 can be realized by rotating the first cover 300 and the lid body 200, for example, the relative movement between the first cover 300 and the lid body 200 can be realized through hole-shaft matching. Alternatively, the first cover 300 may be made of a deformable material, such as plastic, and at least a part of the first cover 300 can move relative to the lid body 200 to cover the water storage tank 210 by bending the first cover 300.

Figure 7:
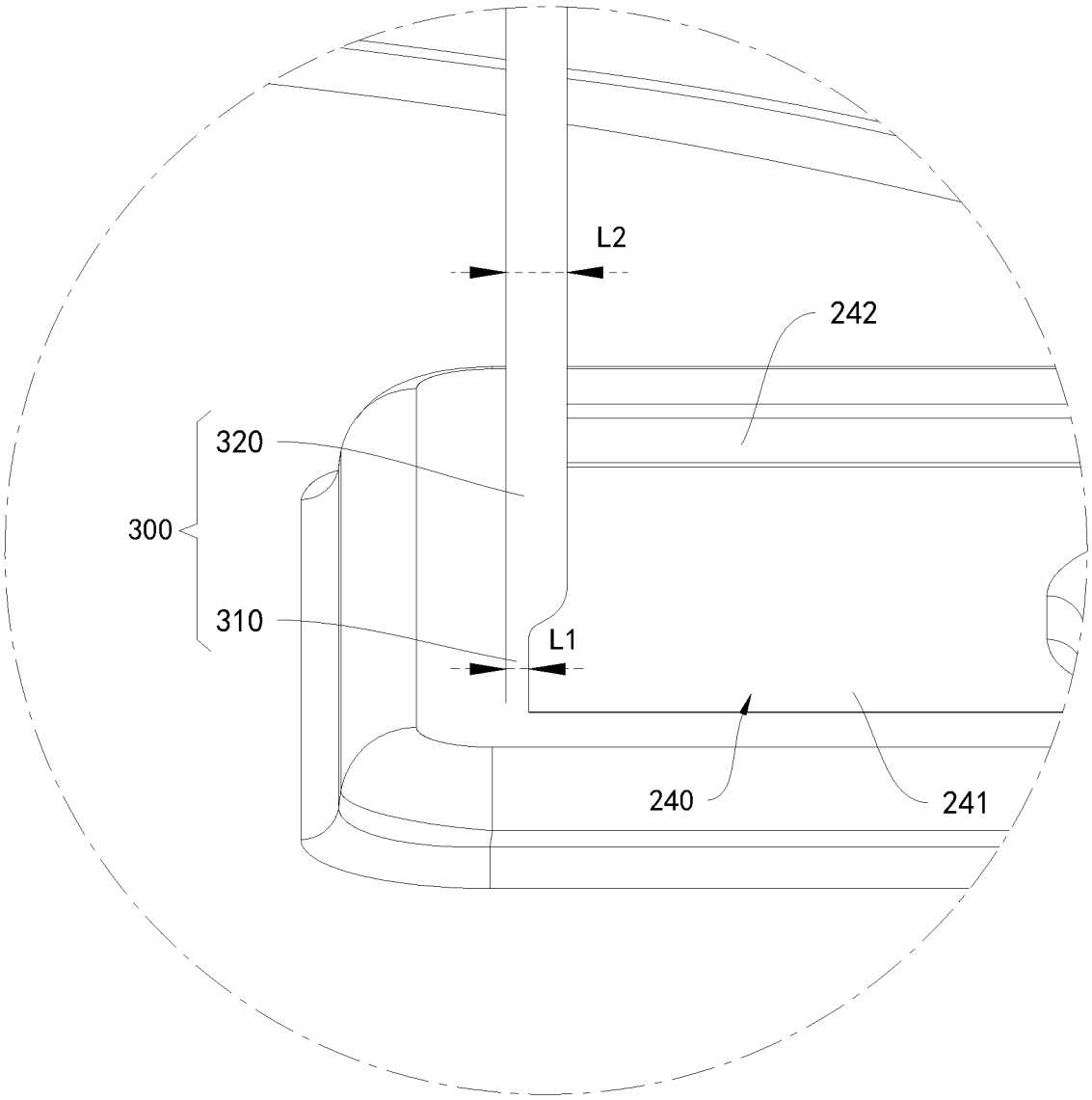
FIG. 7 is another partial schematic diagram of the cup lid in FIG. 1.

Referring to FIG. 7, in the embodiment where the first cover 300 moves relative to the lid body 200 by bending, the first cover 300 comprises a first connecting part 310 and a first covering part 320 which are connected with each other, the first connecting part 310 is connected with the lid body 200, a thickness of the first connecting part 310 is L1, and a thickness of the first covering part 320 is L2,satisfying that: L1<L2. By controlling the L1 and the L2, the first connecting part 310 can be deformed and bent more easily relative to the first covering part 320, so as to keep the first covering part 320 as flat as possible when the first cover 300 is stressed, so as to ensure the subsequent coverage of the water storage tank 210 and reduce the difficulty of bending when the first cover 300 is deformed.

Figure 8:
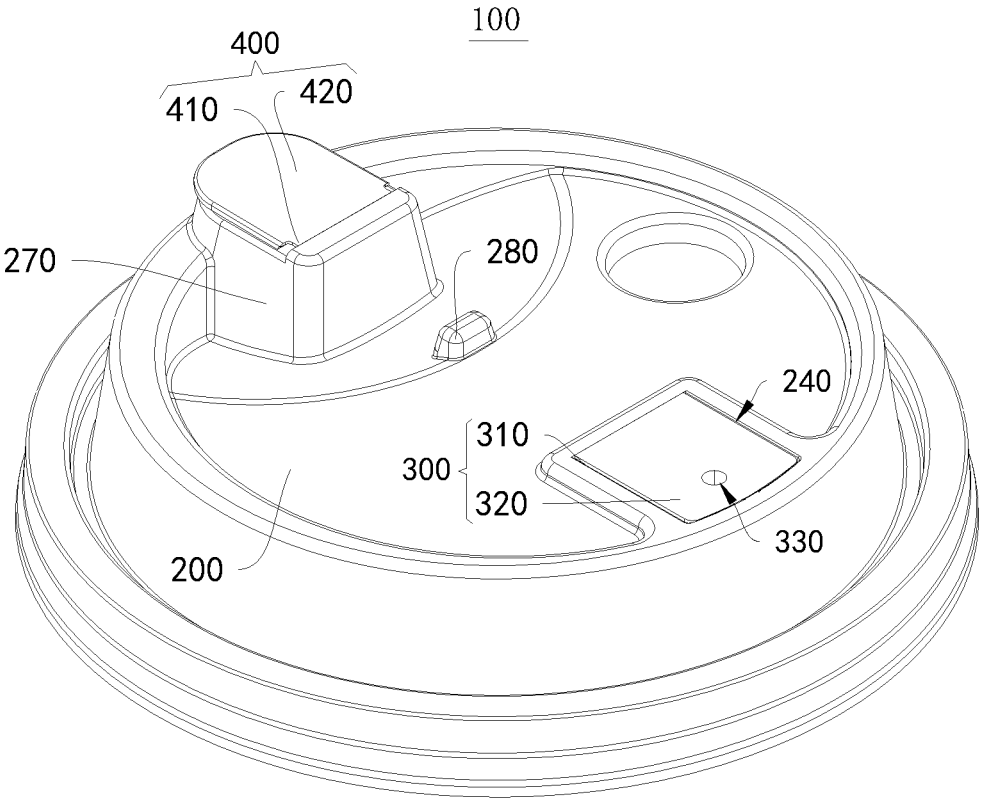
FIG. 8 is a schematic diagram of a cup lid according to another embodiment of the present disclosure.
Figure 9:
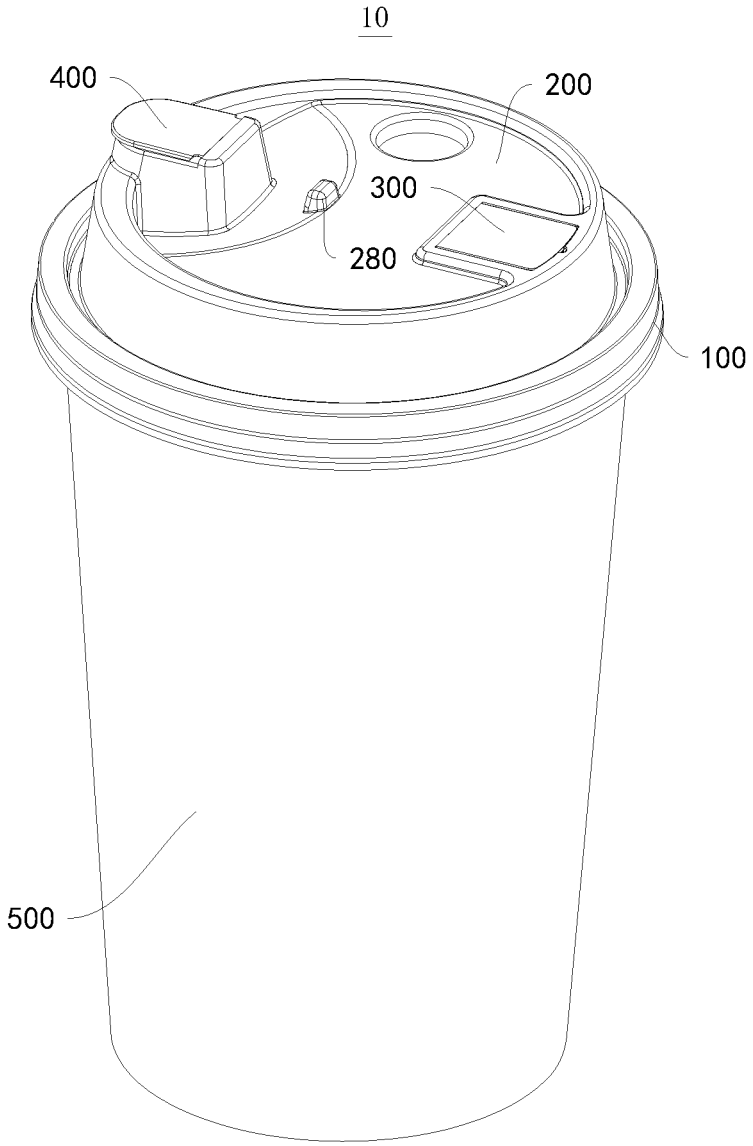
FIG. 9 is a schematic diagram of a cup according to an embodiment of the present disclosure.

Referring to FIG. 8 and FIG. 9, in some embodiments, the first cover 300 is provided with an exhaust hole 330. The exhaust hole 330 extends through the first cover 300. When the first cover 300 is located at the first position, the first cover 300 covers the water storage tank 210, and the exhaust hole 330 is communicated with the water storage tank 210 and the external space to ensure the communication channel between the water storage tank 210 and the external space and ensure that the air pressure inside and outside the cup can be balanced. The exhaust hole 330 and the vent hole 220 may be staggered with each other, so as to further reduce the probability that the liquid in the cup 10 flows out to the outside.

It can be understood that the first cover 300 covers the water storage tank 210, which means that the first cover 300 completely covers the water storage tank 210.

Figure 4:
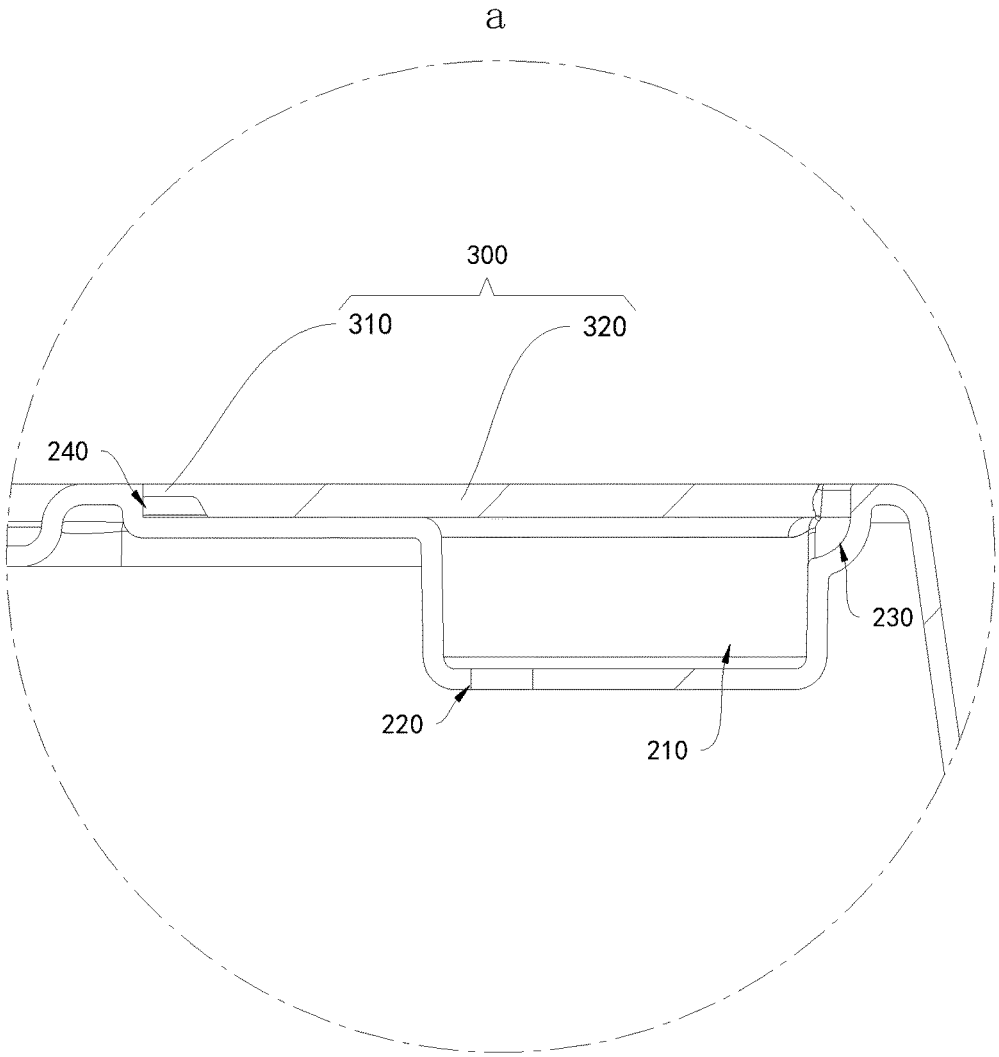
FIG. 4 is an enlarged view of area a in FIG. 3.
Figure 5:
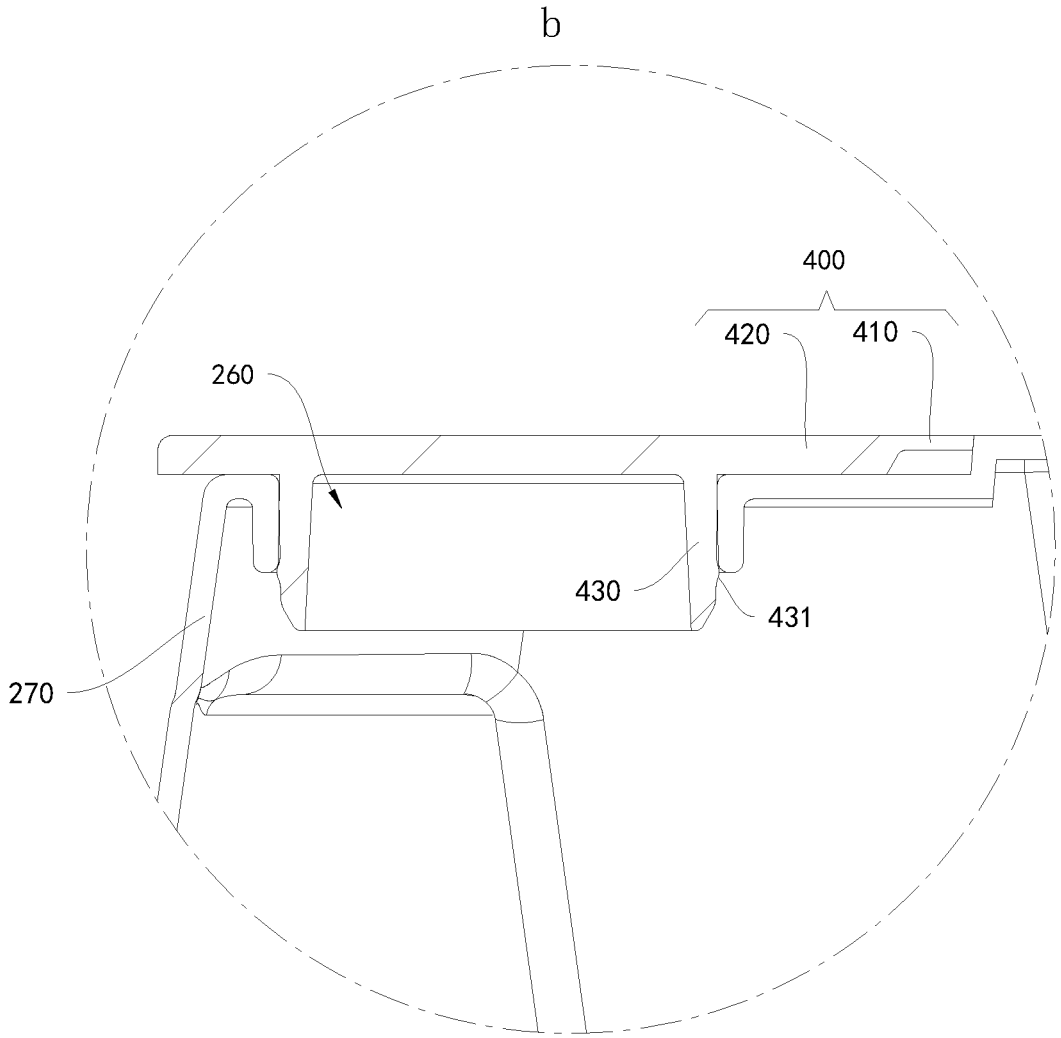
FIG. 5 is an enlarged view of area b in FIG. 3.
Figure 6:
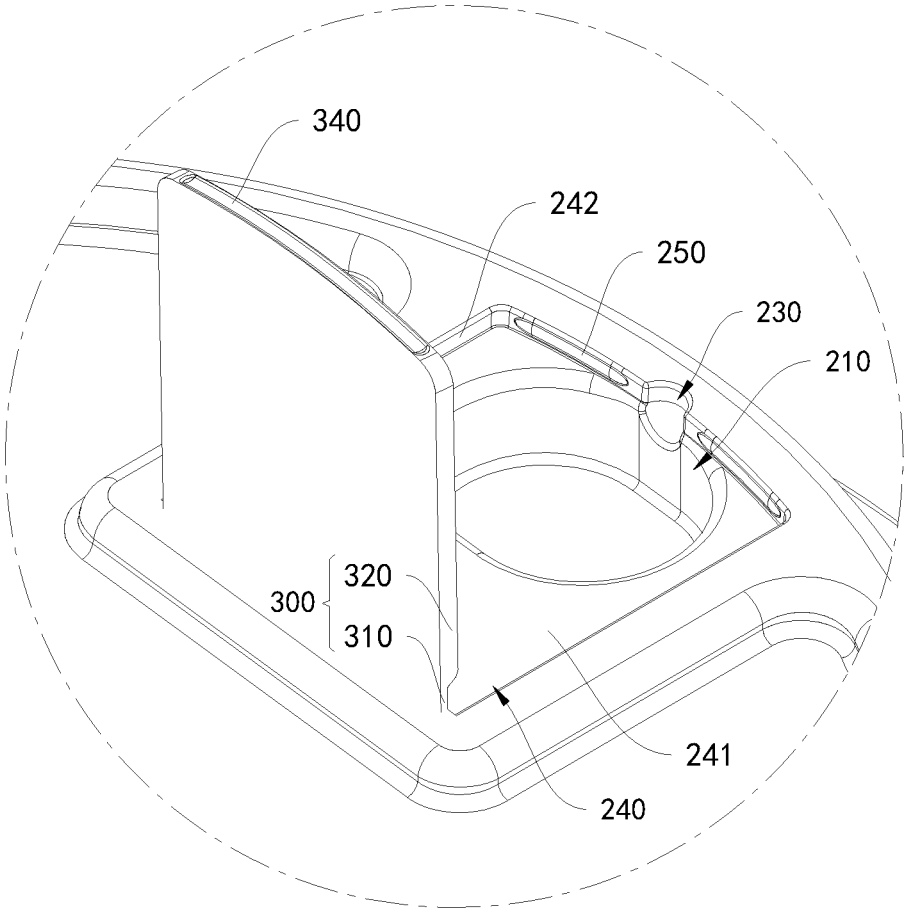
FIG. 6 is a partial schematic diagram of the cup lid in FIG. 1.

Referring to FIG. 4, FIG. 6 and FIG. 9, in some embodiments, the lid body 200 is further provided with an exhaust groove 230. When the first cover 300 is located at the first position, the first cover 300 covers the water storage tank 210, and the exhaust groove 230 is communicated with the water storage tank 210 and the external space to ensure the communication channel between the water storage tank 210 and the external space and ensure that the air pressure inside and outside the cup can be balanced.

The exhaust groove 230 and the vent hole 220 may be staggered with each other, so as to further reduce the probability that the liquid in the cup 10 flows out to the outside.

Furthermore, the exhaust groove 230 and the vent hole 220 are respectively located at opposite sides of the water storage tank 210, so as to increase a distance for the liquid to flow out to the external space from the exhaust groove 230, and further reduce the possibility that the liquid in the cup 10 flows out to the outside.

Specifically, the lid body 200 is provided with a liquid outlet hole 260, and the liquid outlet hole 260 is used for the liquid in the cup to flow out. The water storage tank 210 and the liquid outlet hole 260 are respectively arranged at the two sides of the lid body 200. The vent hole 220 is located on one side of the water storage tank 210 relatively close to the liquid outlet hole 260, and the exhaust groove 230 is located on one side of the water storage tank 210 relatively far away from the liquid outlet hole 260, so that when a user tilts the cup 10 to drink water, the liquid can flow towards the liquid outlet hole 260, so that the liquid overflowing in the water storage tank 210 can flow back through the vent hole 220, and the probability that the liquid flows out from the exhaust groove 230 to the outside is reduced.

Referring to FIG. 6, in some embodiments, one of the lid body 200 and the first cover 300 is provided with a clamping boss 250, and the other is provided with a clamping groove 340. When the first cover 300 is located at the first position, the clamping boss 250 is clamped in the clamping groove 340. The first cover 300 can be kept in the first position through the cooperation of the clamping boss 250 and the clamping groove 340, and a covering effect of the first cover 300 on the water storage tank 210 can be ensured.

Referring to FIG. 1 to FIG. 4, in some embodiments, the lid body 200 is further provided with a covering groove 240, and the water storage tank 210 is located in the covering groove 240, and when the first cover 300 is located at the first position, at least a part of the first cover 300 is located in the covering groove 240. By arranging the covering groove 240, a space can be provided for the movement of the first cover 300, and at least a part of the first cover 300 is located in the covering groove 240 when the first cover 300 is located at the first position, so as to reduce a height of the first cover 300 protruding from an outer surface of the lid body 200 when the first cover is located at the first position. On the other hand, the arrangement of the covering groove 240 can make a step exist in a circumferential direction of the outside of the water storage tank 210, prolong a path of the liquid flowing out of the water storage tank 210 to the outside, increase the difficulty of the liquid flowing out of the water storage tank 210 to the outside, and reduce the probability of leakage of the liquid.

Referring to FIG. 4, in some embodiments, when the first cover 300 is located at the first position, all parts of the first cover 300 are located in the covering groove 240, so that after the first cover 300 is in a covering state, the first cover 300 is flush with the outer surface of the lid body 200, such that an outer surface of the cup lid 100 is smoother.

Figure 2:
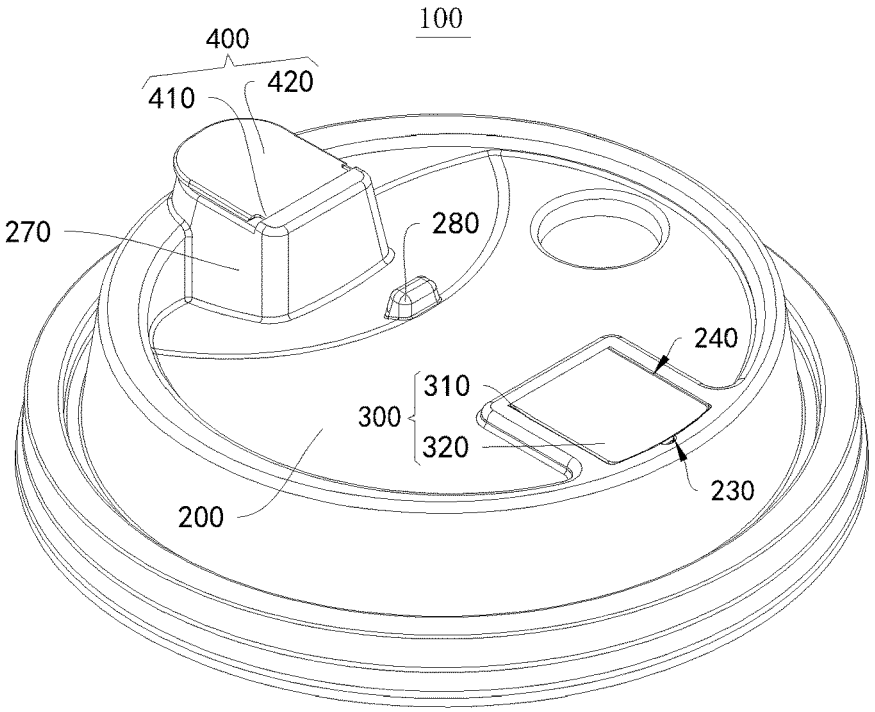
FIG. 2 is a schematic structural diagram of the cup lid in a second state according to an embodiment of the present disclosure.
Figure 3:
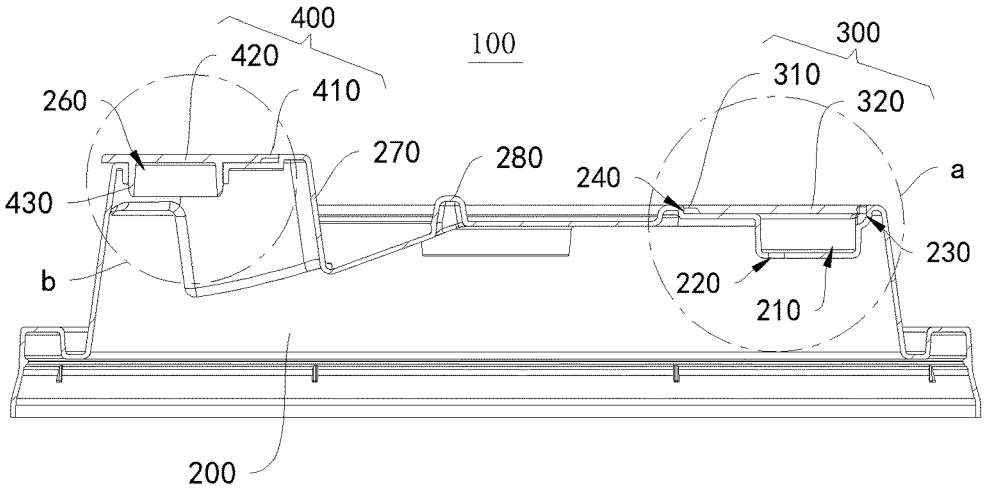
FIG. 3 is a cross-sectional view of the cup lid in FIG. 2.

Referring to FIG. 2 and FIG. 6, as another improvement of the above solution, in the embodiment where the lid body 200 is provided with the exhaust groove 230, the covering groove 240 is provided with a groove bottom 241 and a groove wall 242, and the covering groove 240 is provided with a first side and a second side which are opposite to each other. The exhaust groove 230 is communicated with the groove wall 242 at the first side of the covering groove 240, and the water storage tank 210 is arranged at the groove bottom 241. The first cover 300 comprises a first connecting part 310 and a first covering part 320 which are connected with each other, the first connecting part 310 is connected to the lid body 200, and the first connecting part 310 is located at the second side of the covering groove 240. When the first cover 300 is located at the first position, the first cover 300 covers the water storage tank 210, and the exhaust groove 230 is communicated with the water storage tank 210.

By arranging the exhaust groove 230 on the groove wall 242 of the covering groove 240, the water storage tank 210 can be communicated with the external space, and a space for applying a force to reset the first cover 300 can be provided. When the first cover 300 needs to be turned over, a surface of a side edge of the first cover 300 can be contacted through the exhaust groove 230, so that the first cover 300 can be turned over conveniently.

Referring to FIG. 6, further, the lid body 200 is provided with a clamping boss 250, the first cover 300 is provided with a clamping groove 340, and the clamping boss 250 is arranged on the groove wall 242 at the first side of the covering groove 240. When the first cover 300 is located at the first position, the clamping boss 250 is clamped into the clamping groove 340. By arranging the clamping boss 250 and the exhaust groove 230 on the same side of the covering groove 240, when the first cover 300 needs to be opened after the clamping boss 250 and the clamping groove 340 are clamped, the first cover 300 can be applied with a force through the space provided by the exhaust groove 230 to release the clamping between the clamping boss 250 and the clamping groove 340. The key to release the clamping is to deform the first cover 300, so that the clamping boss 250 slides out of the clamping groove 340. When the exhaust groove 230 and the clamping boss 250 are located on the same side, the deformation of the first cover 300 can be made to be the deformation required for the clamping boss 250 to slide out of the clamping groove 340, which reduces the difficulty of releasing the clamping state and makes it easier for the first cover 300 to be opened to expose the water storage tank 210.

In some other embodiments, the lid body 200 is provided with a clamping groove 340, the first cover 300 is provided with a clamping boss 250, and the clamping groove 340 is arranged on the groove wall 242 at the first side of the covering groove 240. When the first cover 300 is located at the first position, the clamping boss 250 is clamped into the clamping groove 340. Arranging the clamping groove 340 and the exhaust groove 230 on the same side of the covering groove 240 has the same effect as arranging the clamping boss 250 and the exhaust groove 230 on the same side of the covering groove 240, and the description will not be repeated here.

Specifically, the first side and the second side can be different sides to ensure that the first cover 300 can be turned up when a force is applied from the position of the exhaust groove 230. Further, the first side and the second side are two opposite sides, so as to improve the utilization of force and reduce the difficulty of turning up the first cover 300. In some embodiments, the first cover 300 and the lid body 200 are integrally formed. Specifically, the first cover 300 and the lid body 200 are integrally formed by injection molding. Since the first cover 300 can move relative to the lid body 200, referring to FIG. 1, the water storage tank 210 can be exposed when it is not in use, so that the demoulding process in injection molding can be satisfied, and the first cover 300 and the lid body 200 can be integrally formed. The integrated molding method has high preparation efficiency and low preparation cost.

Referring to FIG. 1, FIG. 2, FIG. 3 and FIG. 5, in some embodiments, the lid body 200 is provided with a liquid outlet hole 260 and the liquid outlet hole 260 extends through the lid body 200. The cup lid 100 further comprises a second cover 400, the second cover 400 is provided with a second connecting part 410, a second covering part 420 and a clamping part 430, the second connecting part 410 is connected with the second covering part 420, the clamping part 430 is connected with the second covering part 420, the second connecting part 410 is connected to the lid body 200, and the second cover 400 is capable of moving to a second position relative to the lid body 200. When the second cover 400 is located at the second position, the second covering part 420 covers the liquid outlet hole 260, at least a part of the clamping part 430 is located in the liquid outlet hole 260, and the clamping part 430 is clamped in the liquid outlet hole 260. The second connecting part 410 connects the second cover 400 to the cup lid 100, thus reducing the possibility of losing the second cover 400. The second covering part 420 covers the liquid outlet hole, so that the liquid outlet hole 260 can be closed when drinking is not needed temporarily, and the probability of contamination of the liquid can be reduced. The clamping part 430 is inserted into the liquid outlet hole 260 and clamped in the liquid outlet hole 260, so that a sealing degree of the liquid outlet hole 260 is improved, the second cover 400 can be kept in the second position, and a probability that the second cover 400 is separated from the second position is reduced.

The second cover 400 and the lid body 200 may be integrally formed by injection molding. Since the second cover 400 can move relative to the lid body 200, referring to FIG. 1, the liquid outlet hole 260 can be exposed when it is not in use, so that the demoulding process in injection molding can be satisfied, and the second cover 400 and the lid body 200 can be integrally formed. The integrated molding method has high preparation efficiency and low preparation cost.

Specifically, the relative movement between the second cover 400 and the lid body 200 is realized in the same way as the relative movement between the first cover 300 and the lid body 200. The clamping between the clamping part 430 and the liquid outlet hole 260 can be achieved by interference fit, or a clamping boss 431 may be provided on the clamping part 430, so that the clamping can be achieved by abutting against the clamping boss 431 with the lid body 200 after the clamping boss 431 passes through the liquid outlet hole 260.

The lid body 200 is further provided with a projecting part 270, the projecting part 270 protrudes from the outer surface of the lid body 200, and the liquid outlet hole 260 is arranged on the protruding part 270. The arrangement of the projecting part 270 can position the liquid outlet hole 260 in the mouth as much as possible when the user drinks the liquid, so as to reduce the probability of contact with teeth when the liquid enters, reduce the probability of the liquid flowing out of the mouth, and facilitate the user to drink.

The lid body 200 is further provided with a limiting part 280, and the second connecting part 410 is located between the liquid outlet hole 260 and the limiting part 280. The second cover 400 can be bent in a direction towards the liquid outlet hole 260 or the limiting part 280. When the second cover 400 is bent to a third position, the limiting part 280 abuts against the second cover 400 to keep the second cover 400 in the third position, so as to expose the liquid outlet as much as possible for the user to drink, and reduce the possibility of the second cover 400 contacting with the user.

Specifically, the limiting part 280 is provided with a limiting boss (not shown in the figure), and the movement of the second cover 400 in the direction towards the liquid injection hole is limited by the abutment of the limiting boss against the second cover 400.

Referring to FIG. 1 and FIG. 9, a cup 10 according to an embodiment of the present disclosure comprises a cup body 500 and the cup lid 100 in the above-mentioned embodiments. The cup lid 100 covers the cup body 500. By applying the cup lid 100 of the embodiments of the present disclosure, the water storage tank 210 can be conveniently and quickly covered on the basis of realizing the air pressure balance inside and outside the cup 10, so as to reduce the probability of the liquid flowing out to the outside. Moreover, the probability of losing the first cover 300 is reduced, thus ensuring the normal use of the cup 10.

Specifically, a matching structure for the cup lid 100 and the cup body 500 may be that used in the conventional technology, which will not be described in detail in the present disclosure. The cup 10 may be a cup 10 like a milk tea cup, a coffee cup, a tea cup and the like, which can be used for loading liquid with a certain temperature.

The embodiments of the present disclosure are described in detail with reference to the drawings above, but the present disclosure is not limited to the above embodiments, and various changes may also be made within the knowledge scope of those of ordinary skills in the art without departing from the purpose of the present disclosure. In addition, in case of no conflict, the embodiments in the present disclosure and the features in the embodiments may be combined with each other.

What is claimed is:

1. A cup lid, comprising:

a lid body provided with a water storage tank and a vent hole, wherein the vent hole extends through the lid body and the vent hole is located in the water storage tank; and a first cover connected to the lid body, wherein the first cover is capable of moving to a first position relative to the lid body; and when the first cover is located at the first position, the first cover covers at least a part of the water storage tank;

wherein the lid body is further provided with a covering groove, the water storage tank is located in the covering groove, and when the first cover is located at the first position, at least a part of the first cover is located in the covering groove; and wherein the lid body is further provided with an exhaust groove, the covering groove is provided with a groove bottom and a groove wall, the covering groove is provided with a first side and a second side, the exhaust groove is communicated with the groove wall at the first side of the covering groove, and the water storage tank is arranged at the groove bottom; the first cover comprises a first connecting part and a first covering part which are connected with each other, the first connecting part is connected to the lid body, and the first connecting part is located at the second side of the covering groove; and when the first cover is located at the first position, the first cover covers the water storage tank, and the exhaust groove is communicated with the water storage tank.

2. The cup lid according to claim 1, wherein the lid body is further provided with an exhaust groove, and when the first cover is located at the first position, the first cover covers the water storage tank, and the exhaust groove is communicated with the water storage tank.

3. The cup lid according to claim 2, wherein the exhaust groove and the vent hole are respectively located at two opposite sides of the water storage tank.

4. The cup lid according to claim 1, wherein one of the lid body and the first cover is provided with a clamping boss and the other of the lid body and the first cover is provided with a clamping groove, and when the first cover is located at the first position, the clamping boss is clamped in the clamping groove.

5. The cup lid according to claim 1, wherein the lid body is provided with a clamping boss, the first cover is provided with a clamping groove, and the clamping boss is arranged on the groove wall at the first side of the covering groove; and when the first cover is located at the first position, the clamping boss is clamped in the clamping groove;

or, the lid body is provided with a clamping groove, the first cover is provided with a clamping boss, and the clamping groove is arranged on the groove wall at the first side of the covering groove; and when the first cover is located at the first position, the clamping boss is clamped in the clamping groove.

6. The cup lid according to claim 1, wherein the first cover and the lid body are integrally formed.

7. The cup lid according to claim 1, wherein the lid body is provided with a liquid outlet hole, and the liquid outlet hole extends through the lid body; the cup lid further comprises a second cover, the second cover is provided with a second connecting part, a second covering part and a clamping part, the second connecting part is connected with the second covering part, the clamping part is connected with the second covering part, the second connecting part is connected to the lid body, and the second cover is capable of moving to a second position relative to the lid body; and when the second cover is located at the second position, the second covering part covers the liquid outlet hole, at least a part of the clamping part is located in the liquid outlet hole, and the clamping part is clamped in the liquid outlet hole.

8. A cup, comprising:

the cup lid according to claim 1; and a cup body, wherein the cup lid covers the cup body.

* * * * *